United States Patent [19]

Schjeldahl

[11] Patent Number: 4,590,747

[45] Date of Patent: May 27, 1986

[54] POSITIVE DISPLACEMENT FILLING MACHINE

[75] Inventor: Gilmore T. Schjeldahl, Minnetonka, Minn.

[73] Assignee: Robert Alameda, Salinas, Calif.

[21] Appl. No.: 609,344

[22] Filed: May 11, 1984

[51] Int. Cl.[4] ..... B65B 43/04

[52] U.S. Cl. ..... 53/562; 53/258; 53/550; 53/568; 53/570

[58] Field of Search ..... 53/258, 259, 261, 384, 53/550, 551, 562, 563, 564, 567, 568, 570, 573, 558

[56] References Cited

U.S. PATENT DOCUMENTS

| | | | |
|---|---|---|---|
| 3,044,231 | 7/1962 | Blais et al. | 53/258 |
| 3,094,823 | 6/1963 | Merritt et al. | 53/551 |
| 3,295,289 | 1/1967 | Critchell | 53/551 |
| 3,397,505 | 8/1968 | Critchell | 53/551 |
| 3,462,913 | 8/1969 | Bodolay et al. | 53/562 |
| 3,501,887 | 3/1970 | Umholtz et al. | 53/551 |
| 3,509,689 | 5/1970 | Perrin | 53/384 |
| 3,656,274 | 4/1972 | Vind | 53/562 |
| 3,673,759 | 7/1972 | Ayres et al. | 53/573 |

*Primary Examiner*—John Sipus
*Assistant Examiner*—Donald R. Studebaker
*Attorney, Agent, or Firm*—Orrin M. Haugen; Thomas J. Nikolai

[57] ABSTRACT

Cam driven apparatus for positioning a folded film relative to a film spreading and clamping assembly and which holds an open end of the film, while the film is sealed to form a bag. A cam driven pedestal, in turn, aligns the thus prepared bag with a filling assembly where the bag is grasped and rammed full of produce or the like, before being sealed.

11 Claims, 17 Drawing Figures

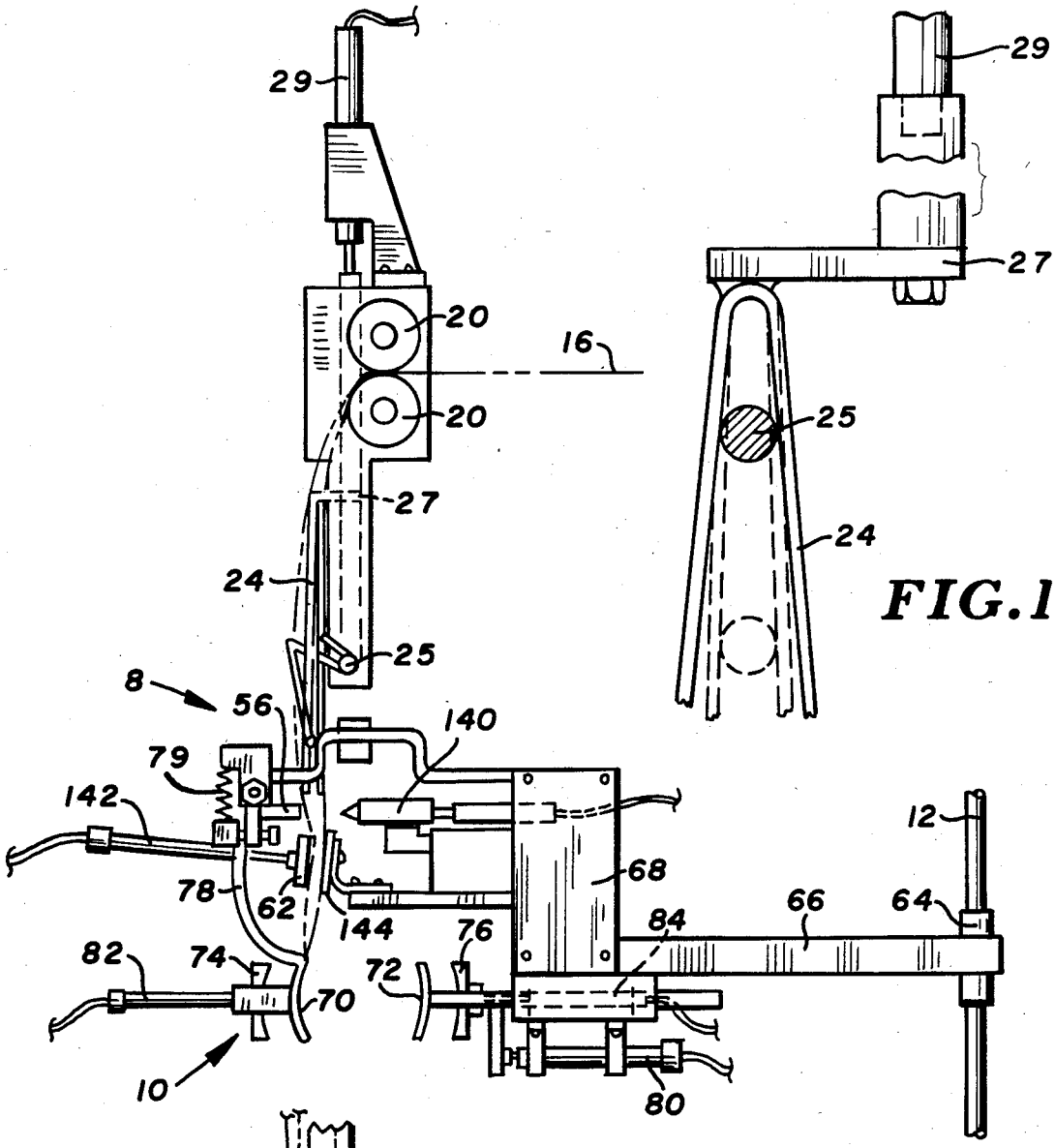
FIG. 11 A
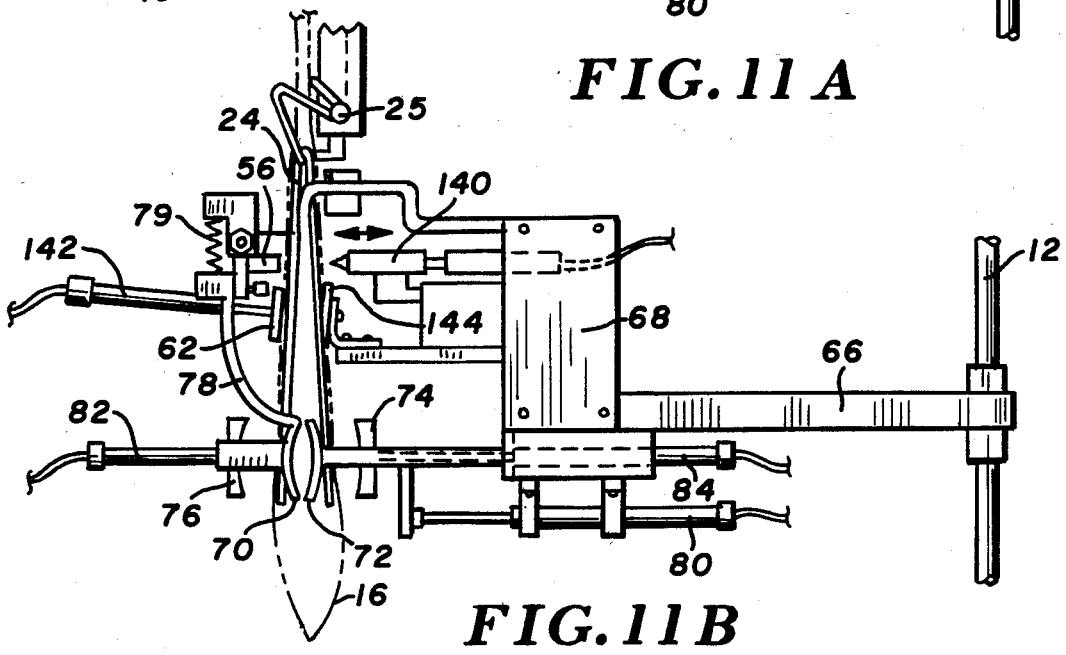
FIG. 11 B
FIG. 10

POSITIVE DISPLACEMENT FILLING MACHINE

BACKGROUND OF THE INVENTION

The present invention relates to packaging machinery and, in particular, to equipment for forming a plastic bag and for facilitating the filling of the bag with produce or the like before sealing the open end thereof.

The packaging of fresh produce such as carrots in individual retail sales wrappers is generally accomplished by hand which is both time-consuming and costly. When produce is shipped in bulk from the processing plant to the retail outlet in large containers, spoilage and damage often occur due to the shear weight of the contained produce and the inherent shifting and jostling that occurs during shipment. This spoilage reduces the saleable quantities and further increases overall costs.

It was with the above problems in mind and with the objective of developing equipment for packaging various types of produce in plastic bags that the present invention was made. The packaging machine to be described generally comprises a hopper arrangement for receiving quantities of produce and means for metering the produce by volume into extensible plastic bags that are formed by the machine and which are held adjacent to an expandable snout or nozzle through which the measured volume of produce is inserted into the stretched bag. Subsequently, the bag is sealed and tied off or otherwise, upon contraction, forms a relatively skin-tight fit about the contained produce. This serves to inhibit spoilage of the packaged product.

Associated with the bag filling assembly is an apparatus for indexably conveying a folded film by driven rollers to a spreading assembly, where the open end of the folded film is separated and each side of the film is clamped in an expandable jaw assembly. Thereafter, the film web is simultaneously sealed and severed via a moving hot knife/anvil assembly so as to essentially seal the sides of the bag. Subsequently, the mouth of the bag is expanded, while the bag is lowered and rotated so as to receive the snout of the produce feeder. Proper drive control and sequencing to the various assemblies is obtained by a timing mechanism comprising a plurality of motor driven cams.

The present invention thus comprises an integral and automatic assembly for producing a bag and for receiving and stuffing measured quantities of produce into the bag. The bag is formed by sealing the side edges of a folded film having a width corresponding to the desired bag length.

SUMMARY OF THE INVENTION

The present invention comprises apparatus for forcibly filling and sealing bags formed from folded film with measured quantities of produce. It comprises a film supply roll and a transport for delivering a folded film in an overhead fashion to a forming station where the bag is partially sealed in a lengthwise horizontal fashion. Specifically, the film, which is open along one edge and both sides, is indexably fed about a spring metal spreader which acts in concert with a pedestal mounted clamping assembly that is capable of being raised or lowered so as to bring bag clamping elements to bear on the film. Upon advancing the film over the separating elements and clamping the opposed sides of the film, a horizontally mounted hot knife/anvil assembly seals the side edges of the bag. The bag mouth is subsequently opened via the clamping elements, lowered and rotated so as to place the bag about a filling nozzle.

The filling assembly comprises an operator filled hopper, which via a pair of bottom mounted, pneumatically controlled flappers, admits a predetermined volume of produce to a ram driven chute. The ram forces the produce into the attached bag via the now-expanded nozzle in such a fashion that the bag is stretched. Once the nozzle is withdrawn from the bag, the bag contracts to form a close-fitting wrap. Subsequentially, the bag is lowered through an assembly where the bag mouth is closed and tied.

The construction and above objects, advantages and features of the present invention as well as various others will become more apparent upon reference to the following detailed description of a preferred embodiment especially when considered in conjunction with the accompanying drawings in which like numerals in the several views refer to corresponding parts.

BRIEF DESCRIPTION OF THE DRAWINGS

FIG. 10 shows a detailed elevation view of the spring metal film expanding assembly.

FIGS. 11*a* through 11*f* show a series of elevation views of the present bag forming assembly at various stages of operation.

DESCRIPTION OF THE PREFERRED EMBODIMENT

Figure 1:
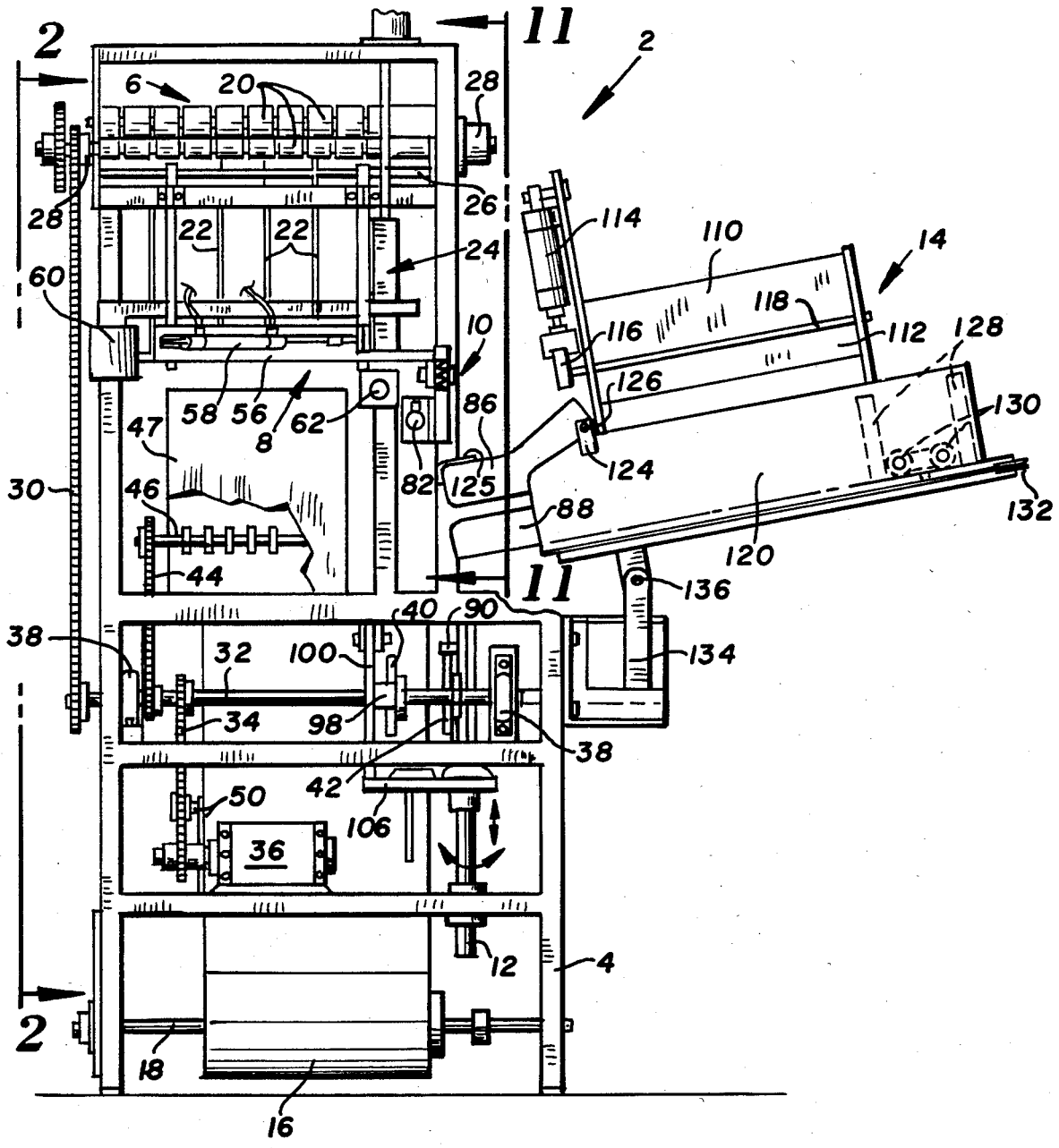
FIG. 1 shows a front elevation view of the packaging equipment of the present invention, including the bag forming and produce stuffing assemblies.

FIG. 1 is a front elevation view of the produce packaging equipment of the present invention and which is identified generally by numeral 2. Mounted on a frame 4 are major subassemblies comprising an overhead film delivery portion 6, a heat sealing/severing portion 8, a bag clamping/spreading portion 10 mounted upon a transfer pedestal 12 (which is raised, lowered and rotated at appropriate times during each cycle's sequence) and a side mounted produce receiving and filling portion 14.

Referring first to the film supply portion 6, it generally is comprised of a roll of longitudinally folded plastic film 16 that is chucked to a free rotating, bottom mounted shaft 18. Folded films 16 of varying widths from 4 to 20 inches and thicknesses of 0.5 to 3 mills and which may or may not contain printing or other graphics that serves to identify and highlight the contained produce and/or package, is threaded about a pair of web tensioning rollers 19 (reference FIG. 2). From there it is routed through a pair indexably driven draw rollers 20 and over a top roller 17 as the film 16 passes from the back to the front of the present apparatus. The film thereafter is held away from the adjacent equipment by the stripping rods 22 and the open end of the film is passed over a spring metal spreader 24, before it is fed past the heat sealing/severing portion 8 to the clamping assembly 10. Also, mounted beneath the draw rollers 20 is a static discharge assembly 26 which prevents the buildup of static electricity on the film 16.

Figure 3:
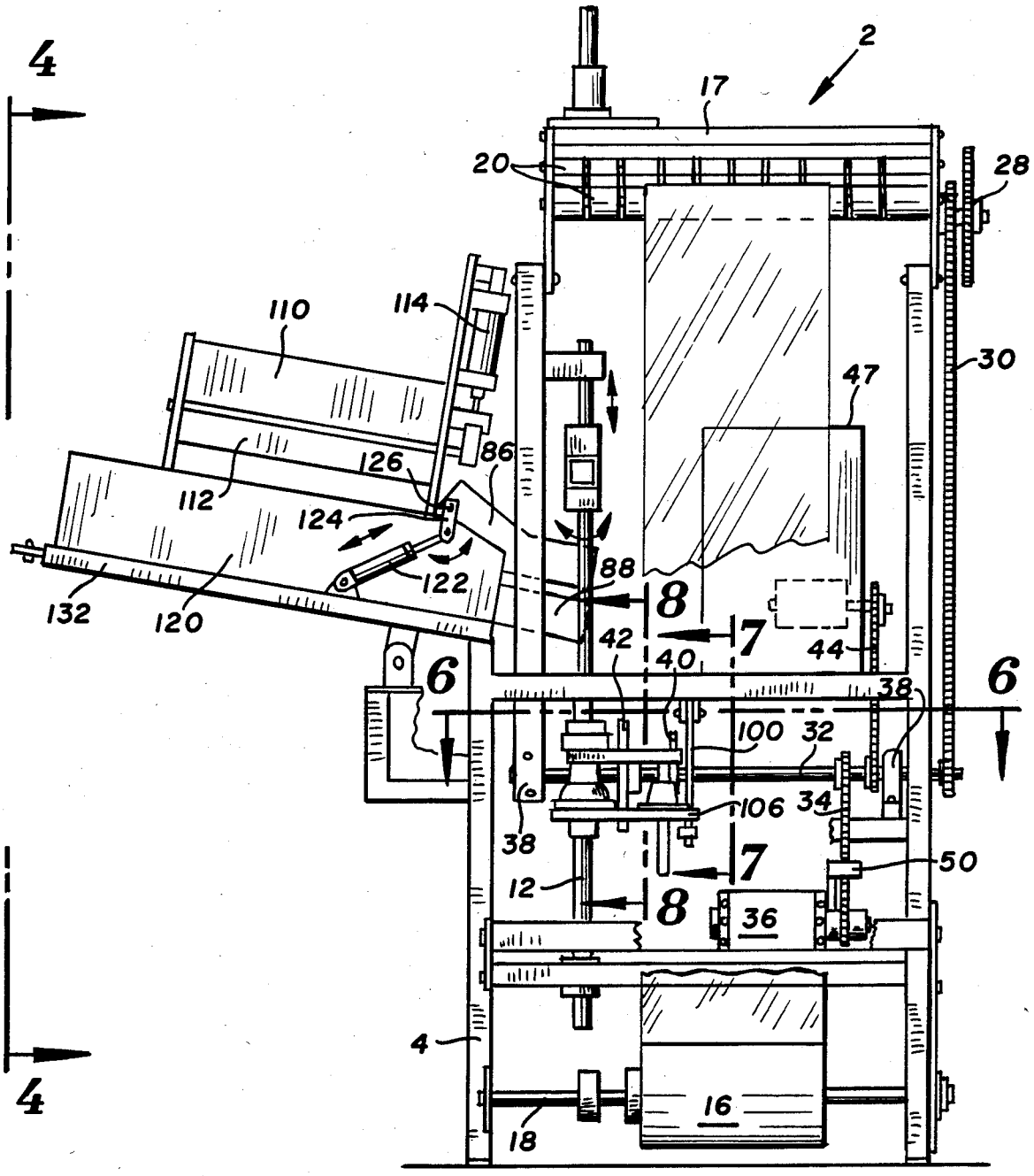
FIG. 3, taken along lines 3—3 of FIG. 2, shows a rear elevation view of the preferred embodiment.

Summarizing the operation, the film 16 is intermittently drawn from the lower roll supply arbor 18 by the end-mounted drive clutches 28, attached to the ends of the lower one of the two draw rollers 20 (FIG. 3) which, in turn, are chain driven, via a linking chain 30, a timing shaft 32 and a transfer chain 34 and a motor 36 coupled thereto. The timing shaft 32 is secured to the frame 4 by a pair of pillow blocks 38 and, additionally, is used to drive a pair of cams 40 and 42 and a timing chain 44 that is coupled to a shaft 46 in enclosure 47 (FIG. 1) containing a plurality of cam operated electrical switches (not shown). The details of the operation of these respective cams will, however, become apparent hereinafter.

Depending upon the type of produce to be wrapped, the duration of drive signals to the clutches 28 is operator set so as to deliver an appropriate amount of film 16 to make a bag of any desired given width. Because, too, the bags are made in a horizontally edgewise fashion relative to the directin of travel of the folded film 16, the width of the film 16 determines the length of the bag, while the amount of material supplied vertically relative to the sealer/severing assembly 8 determines the width of the bag.

Figure 2:
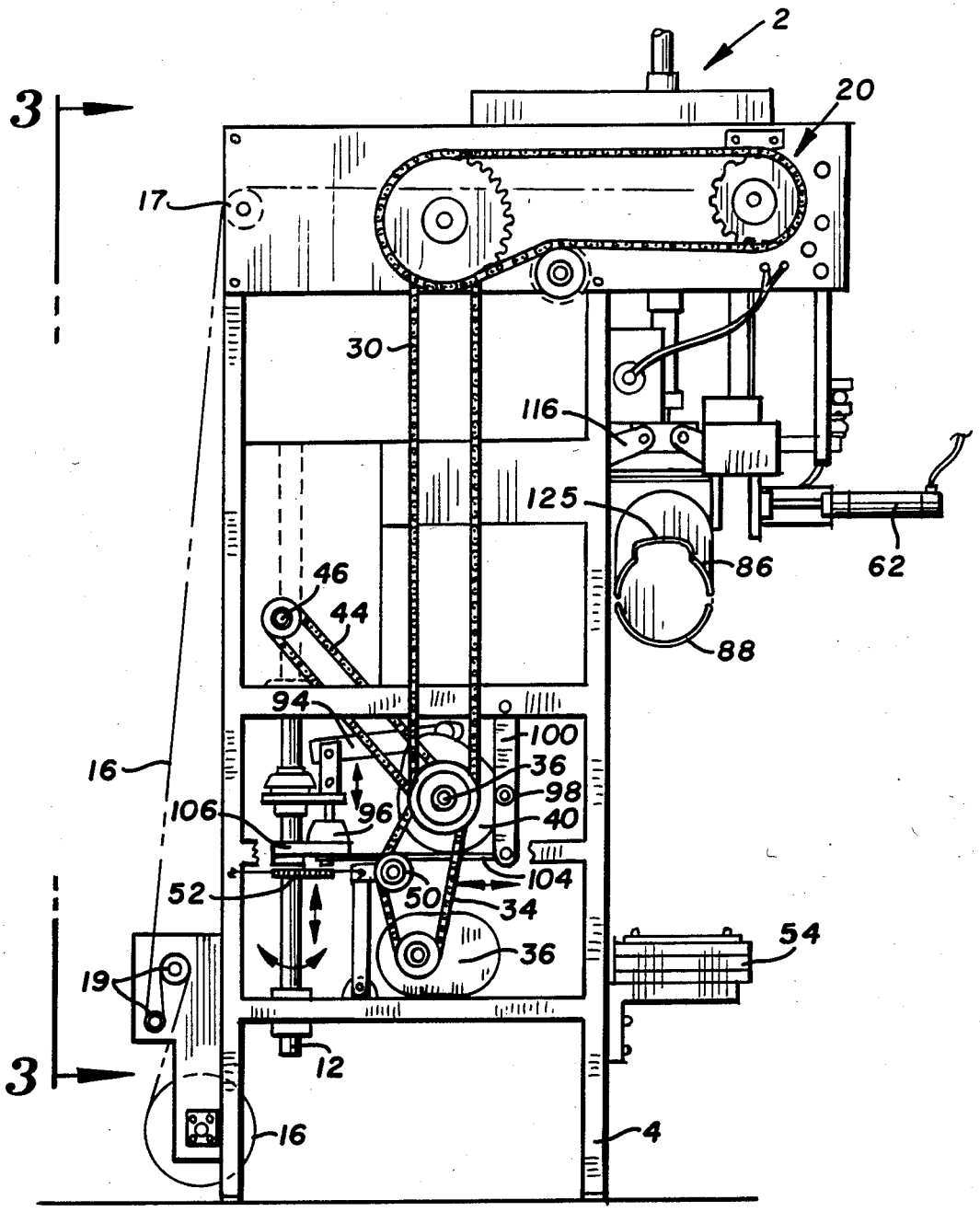
FIG. 2, taken along lines 2—2 of FIG. 1, shows a left side elevation view of the preferred embodiment.

Directing attention to FIG. 2, a left side elevation view taken along lines 2—2 of FIG. 1 is shown. This figure more clearly shows the aforementioned film delivery assembly 6 and the associated chain drives to the timing shaft 32 and draw rollers 20. The film 16 is seen to rise along the rear of the frame assembly, traverses the film tensioner 19, and passes over the idler roller 17, before being fed through the draw rollers 20. A drive chain tensioner 50 is provided for the drive chain 34. This tensioner is coupled to the frame by a spring 52. Also mounted to the front of the present packaging assembly 2 is a bag tying device 54 which, upon receipt of a filled bag, acts to pinch the bag opening and seal it by wrapping a piece of adhesive tape therearound.

Redirecting attention to FIG. 1 and the bag sealing-/severing assembly 8, it is seen to comprise a pneumatically driven anvil 56 that is controllably operable towards and away from a wedge-shaped, heated knife member (not shown) that is mounted to the frame 4. The anvil 56 is preferrably operable via a pneumatic cylinder 58 that is pivotally coupled to the right and left ends of the anvil 56 so as to cause the anvil 56 to move in a parallel fashion towards and away from the heating element. Mounted above the heating element is a tubular, multi-ported blower assembly 60, the ports of which are directed and controllably operated so as to cool the film 16 just after each sealing/severing operation. Thus, as the film 16 passes through and is held away from the packaging assembly 2 via the stripper bars 22, it passes between the anvil 56 and the hot knife. Once the film 16 is advanced to provide the proper predetermined bag width, it is transversely sealed and severed. This sealing operation is facilitated by a pneumatically driven clamp 62 that is mounted on the right side of the anvil 56 and which acts to squeeze the opposite sides of the film 16 together, just prior to sealing/severing the film 16 with the hot knife. The details thereof will be further explained apparent hereinafter.

Figure 9:
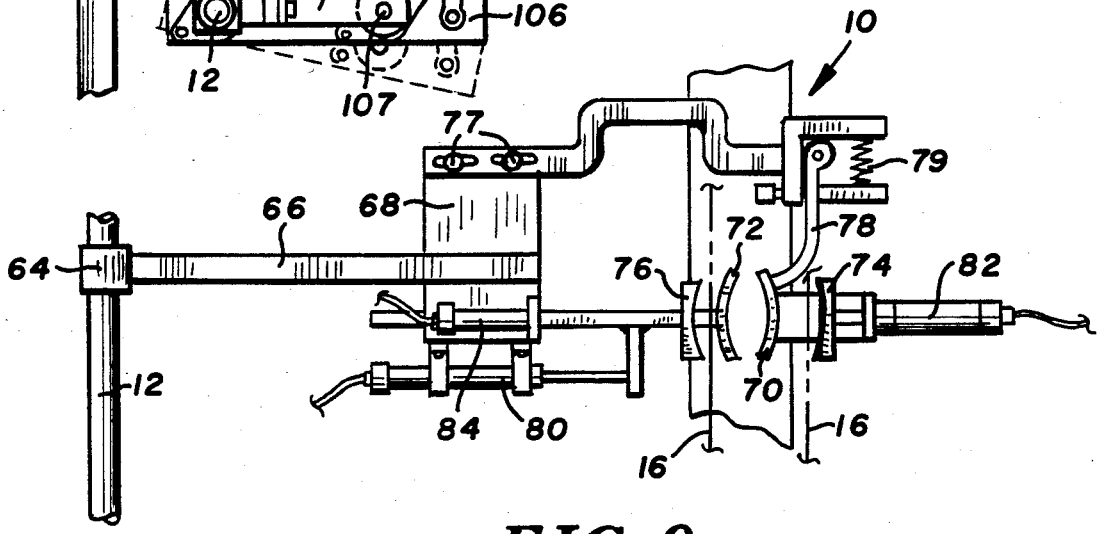
FIG. 9 shows a detailed elevation view of the pedestal and associated clamping members.

Directing attention now to the pedestal 12 mounted to the right side of the machine 2, it is cam operated by the cams 40 and 42 so as to controllably raise and lower and rotate during the various timed phases of machine operations. Mounted to the pedestal 12 at its upper end is the portion of the clamping assembly 10 which operates upon the expanded open-end of the film 16. The details of the clamping assembly can better be seen by referring to FIG. 9 which shows the clamping portion of the clamping/spreading assembly 10 being orthogonally coupled to the upper end of the pedestal 12 by a coupler 64 and tubular member 66 to a flat plate 68 to which are attached a pair of pneumatic linear actuators for operating bag clamping plates 70 and 72. Complimentary presser feet 74 and 76 are mounted opposite to the backsides of the clamping plates 70 and 72. The opposite sides of the folded web of film 16 pass between the presser feet 74 and 76 and clamping plates 70 and 72.

In operation, upon enabling the pneumatic cylinder 78, the clamping plate 72 is laterally directed toward clamping plate 70 and it remains in the position established by the bolts 77 holding the plate 68. It is to be noted, though, that the clamping plate 70 is supported by a curved arm 78 that has tension induced thereon via a spring 79. Upon bringing the expansion plates 70 and 72 together, the sides of the film 16 at the open edge pass freely in the space between the clamping plate 70 and 72 and the associated presser feet 74 and 76. Just prior to the sealing operation, however, the pneumatic cylinders 80 and 82 associated with the presser feet 76 and 74 are actuated so as to bring the presser feet 74 and 76 to bear against their associated clamping plates 70 and 72 and thereby clamp the sides of the film 16 therebetween. At the same time, the overlying bag clamp assembly 62 clamps and immobilizes the upper end of the film 16 before the film 16 sealed and severed by the hot knife. Subsequently, the thus formed bag is opened via the retraction of the cylinder 80 and this causes the closed clamping plate 72 and presser foot 76 to retract and thereby expand the open end of the bag. Thereafter, the pedestal 12 is lowered and rotated and the opened bag is inserted onto the upper and lower snout portions 86 and 88 of the produce filling assembly 14. The details of this assembly will be described in greater detail hereinafter.

The clamping/spreading assembly 10 also includes a film spreading portion that includes the spring metal spreader 24. A detailed right side elevation thereof can be seen upon reference to FIG. 10 which shows the elongated, bent spring metal member 24 in its rest position. In this position, the member 24 is adjacent to the right side stripper bar 22. The member 24 is bent in an inverted "V" shape and a bent rod member 25, attached to the frame 4, is positioned within the sides of the inverted member 24. The member 24 is mounted to a slidable weldment 27 that is coupled to a pneumatic cylinder 29 at its upper end. One end of the cylinder 29, in turn, is attached to the frame 4, and thus, the spring metal member 24 may be raised and lowered relative to the rod member 25. Because the member 24 is disposed within the opposed open edges of the film 16, upon lowering the member 24 so that it overlies the closed clamping plates 70 and 72, the inverted V-member 24 is spread by the rod 25 and it guides the film 16 over the clamping plates 70 and 72. Thereafter, the spreader member 24 is raised and the film 16 is sealed and severed to form a bag. Thus, the spring metal member 24 acts to expand and guide the film onto the clamping portion of the assembly 10.

Figure 7:
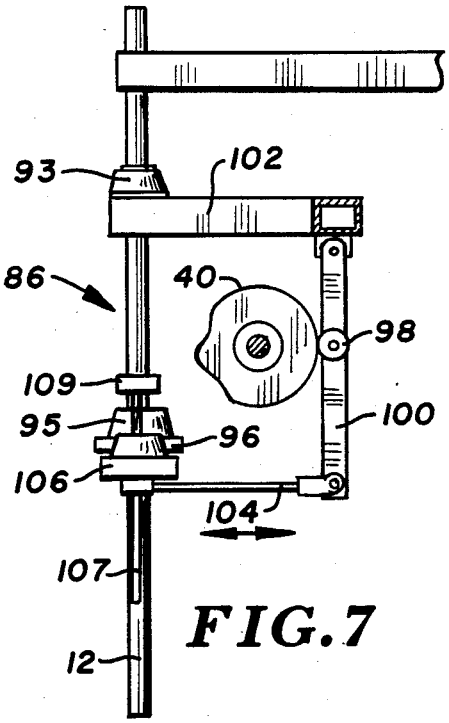
FIG. 7 shows an end elevation view of the cam drive for rotating the pedestal mounted clamping members.
Figure 8:
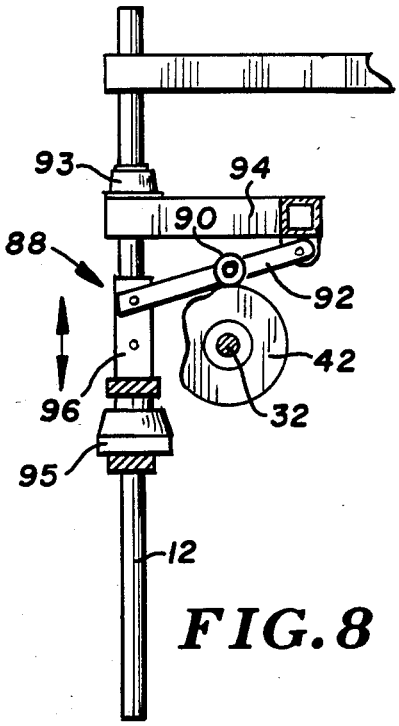
FIG. 8 shows an end elevation view of the cam drive for raising the pedestal mounted clamping members.
Figure 6:
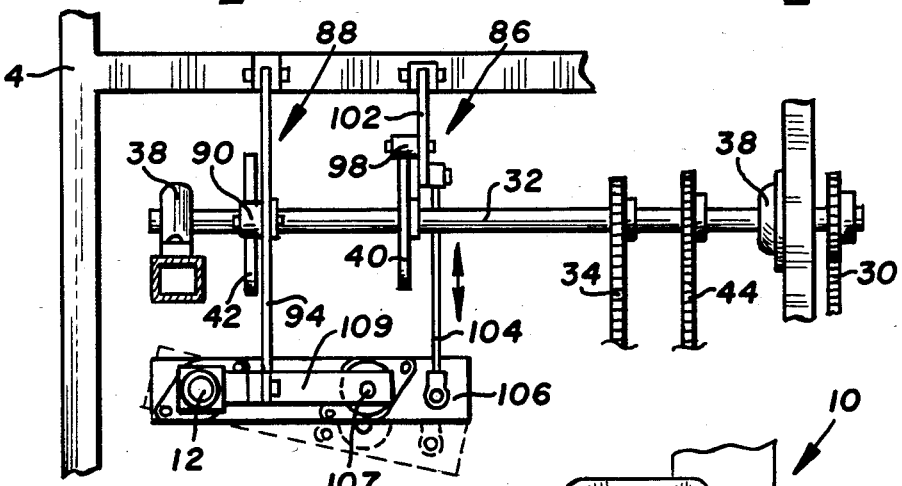
FIG. 6 shows a top view of the cam drive assembly.

Recalling from the above discussion of FIG. 1 that the motor driven timing shaft 32 contains a pair of pedestal actuating cams 40 and 42, attention is now directed to FIGS. 6, 7 and 8 wherein more detailed views are shown of the associated cam follower linkages used to raise, lower and rotate the pedestal 12. Specifically, FIG. 6 depicts a detailed top view of the timing shaft 32 relative to the cams 40 and 42 and their respective cam follower linkage assemblies 86 and 88. Overlying the cam 42 is a cam follower 90 that is secured to a linking arm 92. The linking arm 92 is pivotally attached at each of its ends to an overlying support member 94 that is attached to the frame 4 and to an underlying member 96 that is clamped to the pedestal 12. The pedestal 12 is slidably mounted in upper and lower bushings 93 and 95. Thus, as the cam 42 rotates, the cam follower 90 follows its profile and causes the linking arm 94 and the pedestal 12 to raise and drop. Because the clamping portion of the assembly 10 is coupled to the pedestal 12, it also is raised and lowered as the cam 42 rotates.

Referring still to FIG. 6, the cam 40 and its associated linkage assembly 86, is transversely mounted from the cam 42 along the timing shaft 32. From FIG. 7 it can be seen that its associated cam follower 98 is disposed on a linking arm 100 which is pivotally suspended from an overlying arm 102 attached to the frame 4. A lower lying linking arm 104 attaches to a transversely extending arm 106 that is clamped to the pedestal shaft 12. Rising from the arm 106 is a shaft 107 that attaches to an upper support arm 109 clamped to the pedestal 12. Thus, as the cam follower 98 traverses the profile of cam 40, the linking arm 100 moves to the right and left. This movement, in turn, is translated to a rotational movement of the linking arm 106, the support arm 109 and the pedestal shaft 12. This movement is shown by a dotted line in FIG. 6. The clamping portion of the assembly 10 moves toward and away from the snout portions 86 and 88 of the produce filling assembly 14.

In explaining the produce receiving and filing assembly 14, reference is made to FIGS. 1, 2, 3, 4 and 5. In FIG. 1, the produce supply assembly 14 is comprised of an overlying produce reservoir or hopper 110 which is manually or machine fed to contain a quantity of produce to packaged. The bottom of the hopper 110 is comprised of a pair of inwardly directed and pivotally mounted flapper plates 112, which are pneumatically controlled by a pneumatic cylinder 114 and its associated linkage assembly 116 and each of which plates 112 also include an axle 118. Thus, upon actuating the cylinder 114, it controllably causes the linking elements 116 to pivot which, in turn, pivots the axles 118 and plates 112. In response thereto, produce contained within the hopper 110 drops into the chute 120 in a volume determined by the area subtended beneath the opened plates 112.

However, before the produce is dropped during operation, the forward, pivotally-mounted snout portion 86 is engaged by its associated linking assembly 122 so as to pneumatically raise and grasp a bag, previously inserted over the relaxed upper and lower snout elements 86 and 88. In particular, the nozzle element 86 is raised and lowered via a pneumatic cylinder 122, that is mounted on the backside of the chute 120 and which can perhaps better be seen in FIG. 3. A pair of linking arms 124 mounted on opposite sides of the snout element 86 are interconnected by an axle 126 to the air cylinder 122 so that upon actuation of the cylinder 122 the arms 124 pivot and cause the snout portion 86 to raise and lower. The raising of the snout portion 86 within the open end of a preformed bag, in turn, causes the clamping thereof, prior to filling the bag with produce from the hopper 110. It should be noted, too, that a lip 125 is provided on the snout portion 86 for facilitating the containment of the bag.

The deposited volume of produce is ejected from the chute 120 by a pushing carriage 128 that is mounted upon a pair of wheels 130 internal to the chute 120. This carriage is driven by a pulley drive assembly 132 located beneath the bottom of the chute. The pulley drive 132 is operated so as to cause the pushing member 128 to move to and fro, much like a shuttle within the chute 120. During its forward movement, it causes the forced ejection of the produce into the contained bag.

Figure 4:
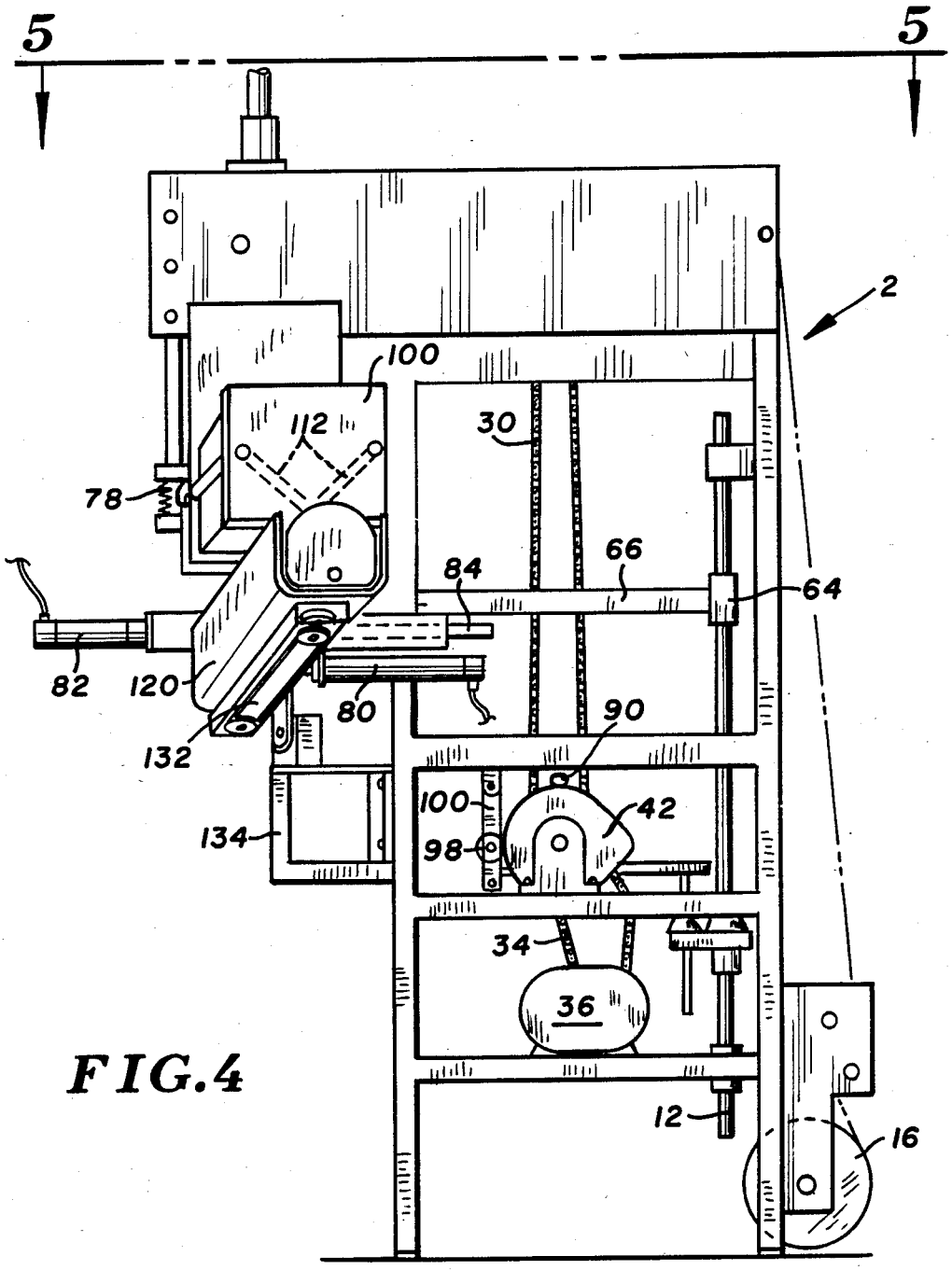
FIG. 4, taken along lines 4—4 of FIG. 3, and a right side elevation view of the present equipment.
Figure 5:
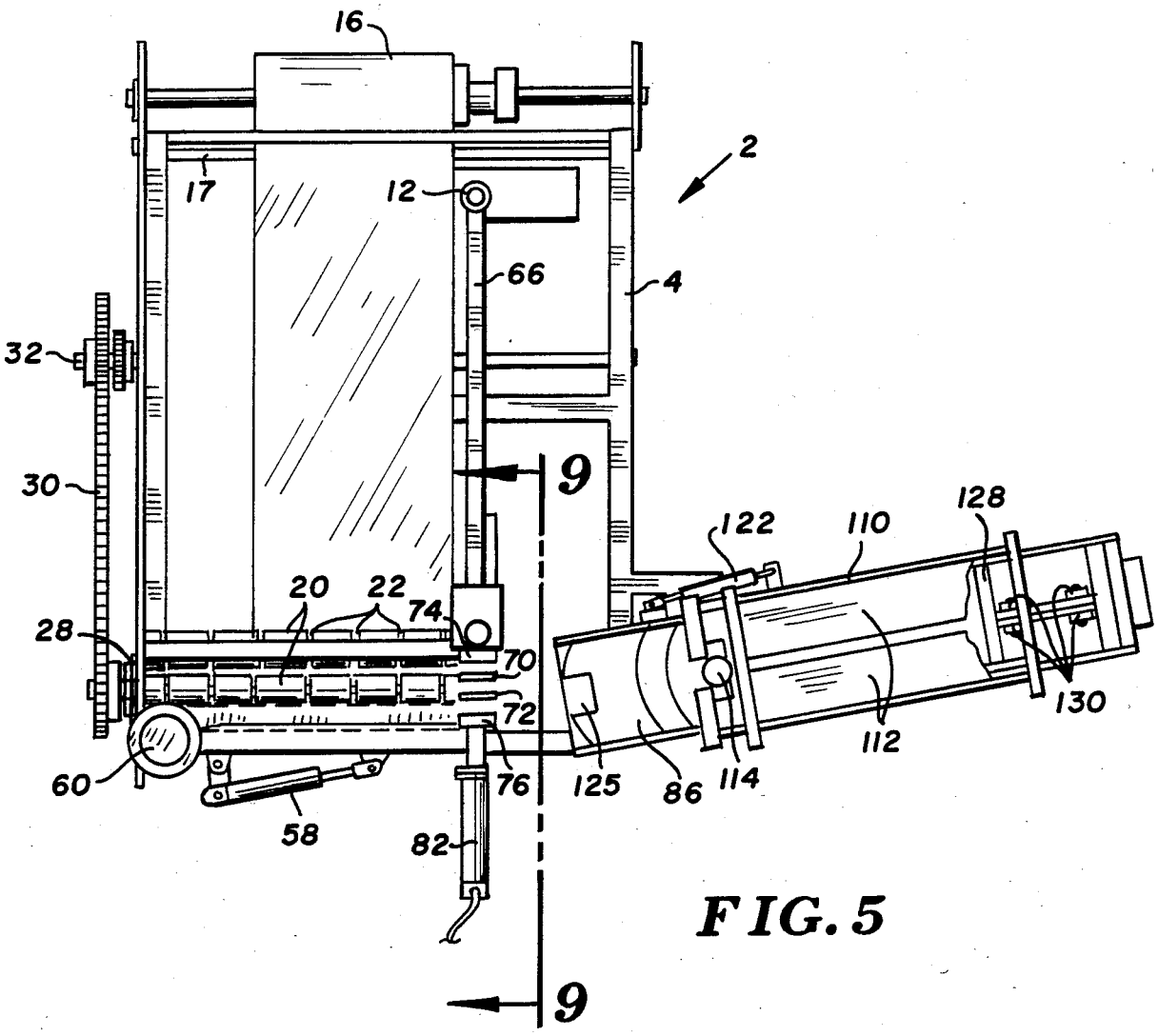
FIG. 5, taken along lines 5—5 of FIG. 4, shows a top view of the present invention relative to the side mounted loading nozzle.

FIG. 4 shows more of the details of the relative disposition of the chute 120, drive 132 and hopper 110. The chute 120 is pivotally attached to the frame 4 via a weldment 134 that is welded at an angle to the frame 4. The inclination of the chute 12 can be adjusted by loosening or tightening the bolt 136 that passes through the upper end of the weldment 134. Typically, though, the inclination of the chute relative to the floor is set somewhere between 0° degrees and 45° degrees. The angle of the shoot 120 to the frame 4, is also adjustable via bolts through the bottom of the weldment 132 within a range of 0 degrees to 45 degrees. These adjustments thus facilitate the transfer of the bag opening over the snout.

Figure 11C:
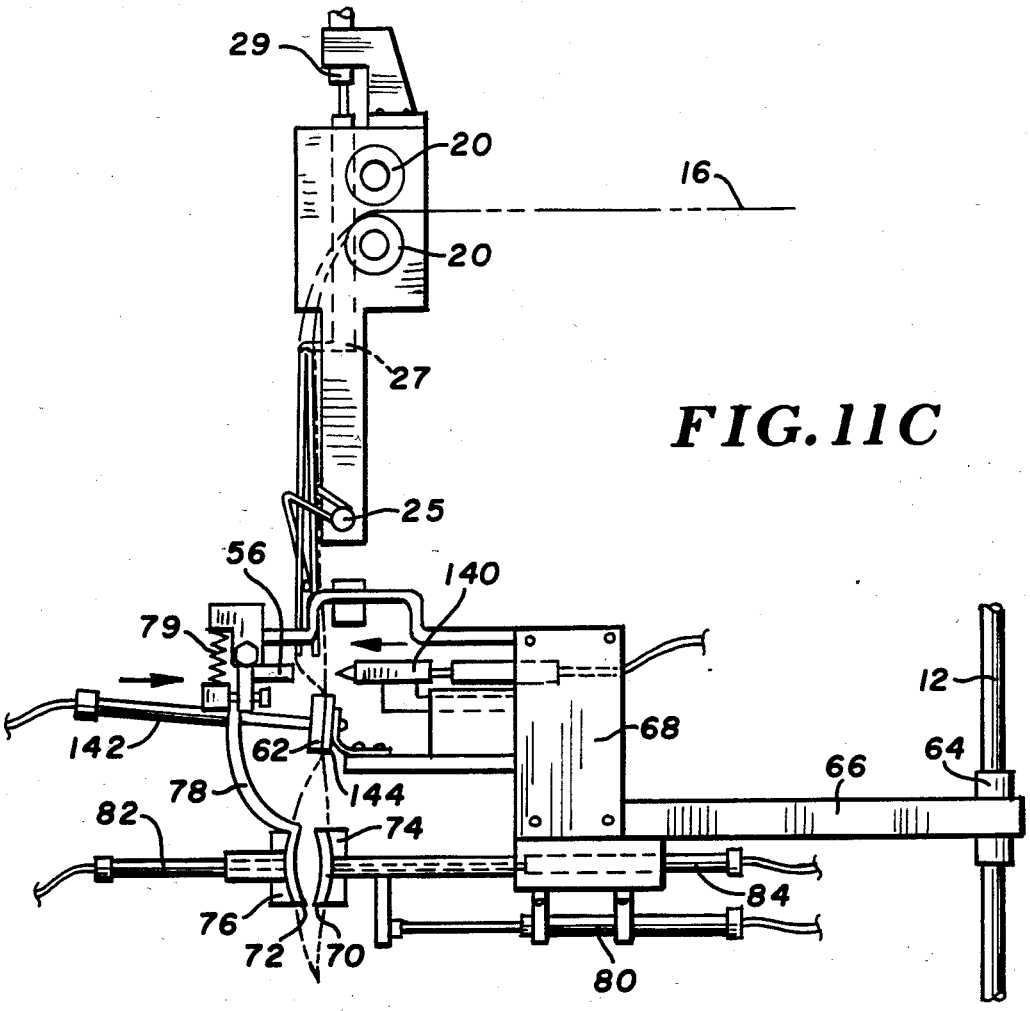

FIGS. 11*a* through 11*f* show the details of the sequential operation of the present packaging apparatus 2. In that regard, attention is also directed to the timing diagram of FIG. 13 wherein the sequence of occurrence of the various machine operations is shown relative to a typical cycle time and cam dwell. Referring to FIG. 11*a*, a right side elevation view is shown of the sealing-/severing assembly 8 and the spreader/clamping assembly 10 relative to the pedestal 12. In FIG. 11*a*, the clamping assembly is shown with the clamping plate 72 retracted from clamping plate 70 and with the presser feet 74 and 76 retracted from the clamping plates. At the same time, the anvil 56 is retracted from the hot knife 140, while the film clamp 62 is retracted, via its air cylinder 142, from its stationary plate 144. Also, the web spreader portion of the assembly 10 is raised, such that the arms of the spring metal member 24 are relaxed and together. During this condition, the drive clutches 28 are engaged so as to permit the draw rollers 20 to advance the film and during which operation the air cylinder 80 is enabled so as to bring the clamping plate 72 to bear against the clamping plate 70, before the film 16 reaches the clamping plates 70 and 72. Just prior thereto and approximtely at 40° of dwell, the air cylinder 29 is enabled so as to lower the spring metal member 24 relative to the rod member 25 and thereby expand the open end of the film 16 and guide the sides of the film web over the closed clamping plates 70 and 72. This condition is shown in FIG. 11*b* which continues until approximately 55° of dwell at which time the spring metal member 24 is raised.

Referring now to FIG. 11*c*, the air cylinders 82 and 84 are next enabled so as to bring the presser feet 74 and 76 to bear against their associated clamping plates 70 and 72 and thereby clamp the sides of the previously advanced and separated film 16. The air cylinder 142 is thereafter enabled so as to clamp the upper side of the film web and bag being prepared between the clamp member 62 and the stationary member 144. At that time or at approximately 60° of dwell, the air cylinder 58 is enabled. This causes the anvil 56 to bring the film 16 to to bear against the hot knife 140 and thereby seal and sever the film 16. After the first cycle, the bottom side seal of the next following bag is formed during the first sealing and severing operation and that thereafter, a completed bag is formed after each sealing and severing operation. The sealing operation continues until approximately 80° of dwell and after which the anvil 56 is retracted.

Figure 11D:
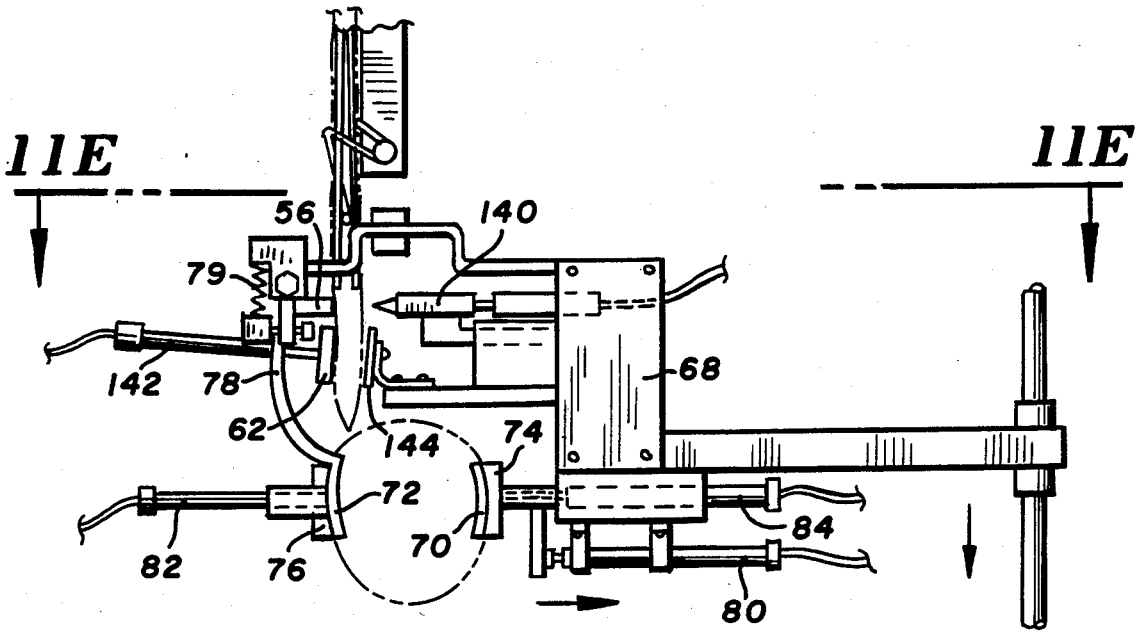
Figure 11E:
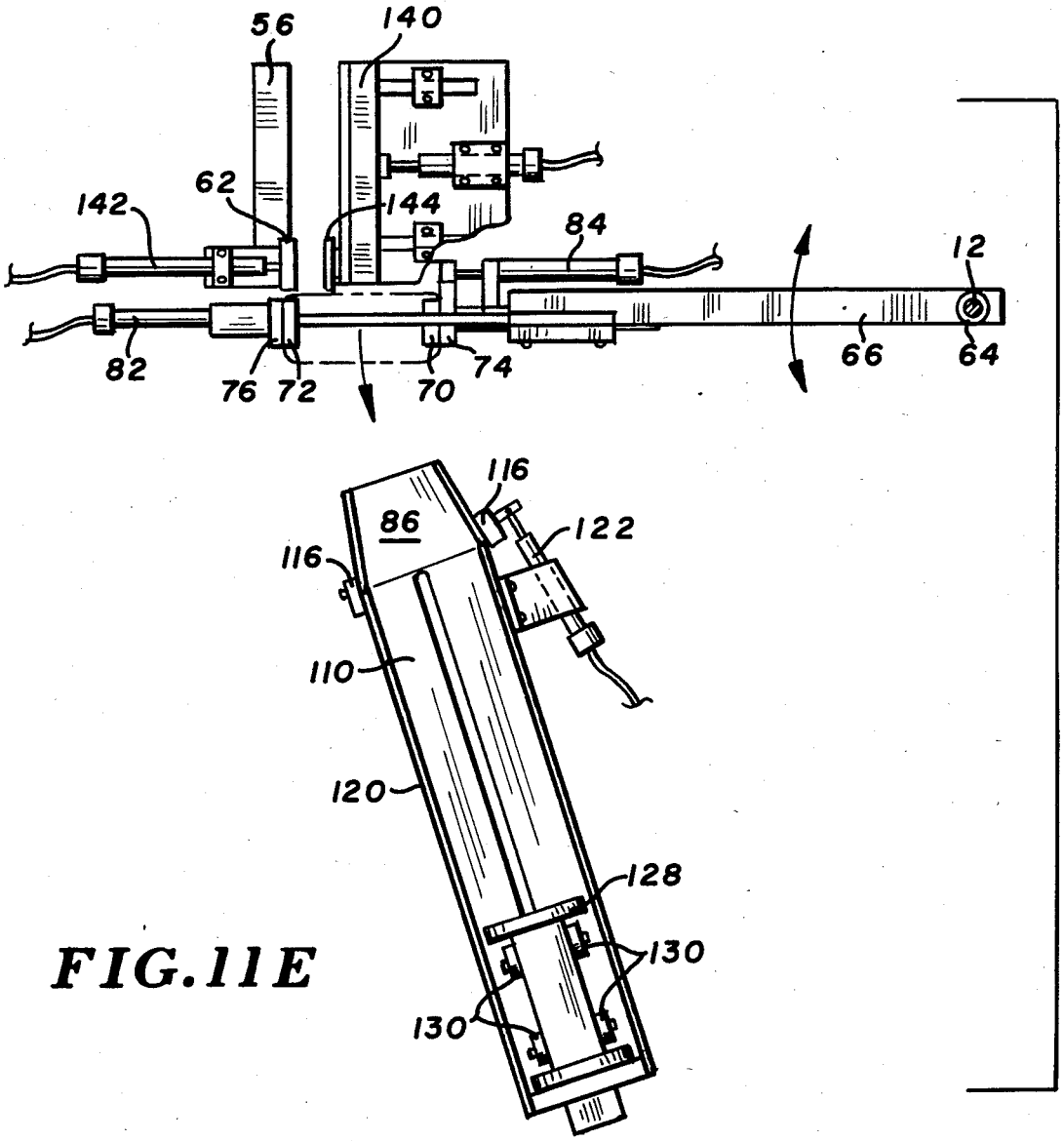

Referring now to FIG. 11*d*, at approximately 80° of dwell, the pedestal 12 is lowered and at the same time, the air cylinder 84 is disabled so as to retract the clamping plate 72 and its associated clamped presser foot 76 and thereby open the mouth of the prepared bag. This condition can also be seen upon reference to FIG. 11*e* wherein a top view is shown of the clamping portion of the assembly 10 holding an opened bag relative to the produce filling assembly 14.

Figure 11F:
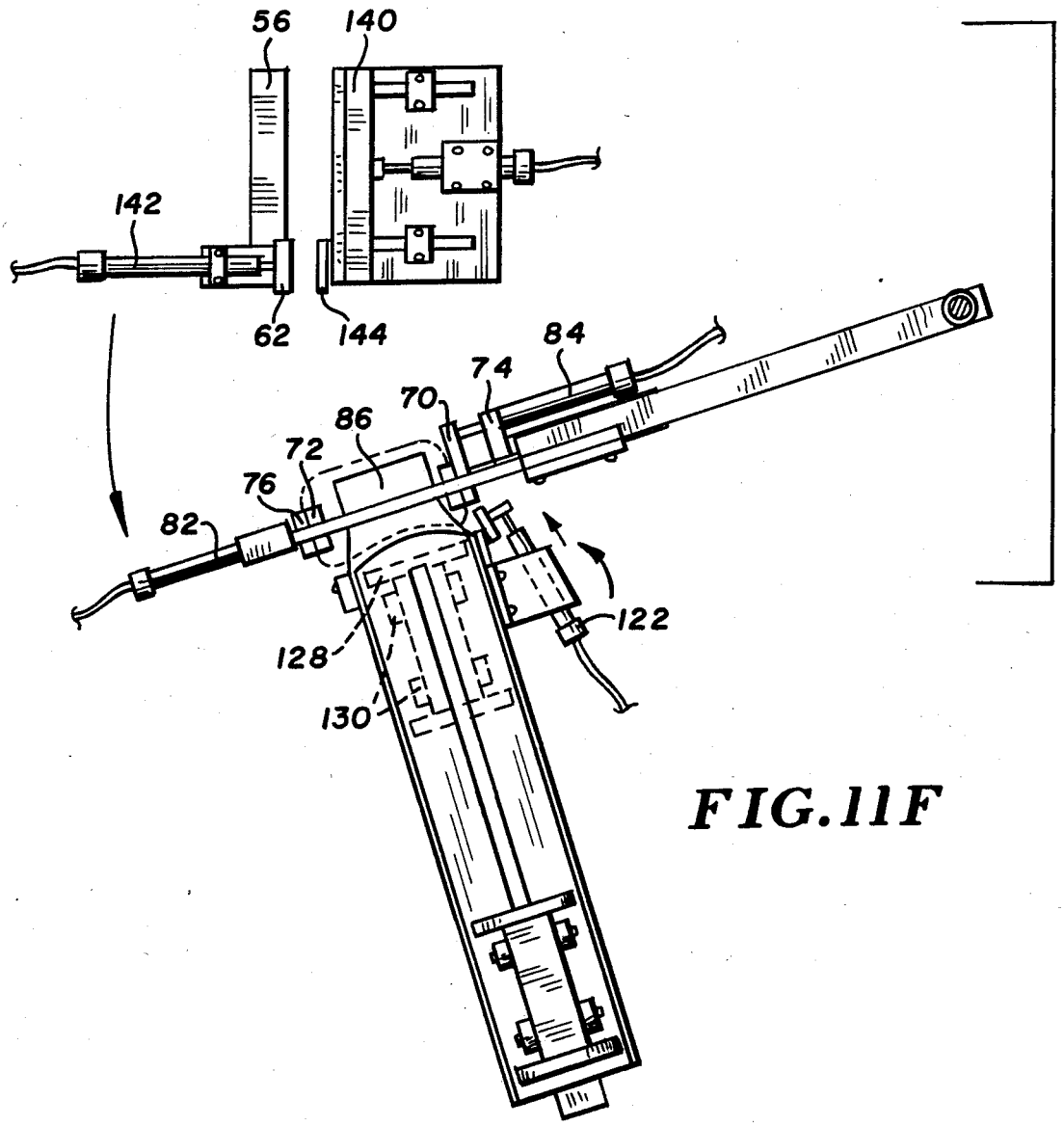
Figure 12:
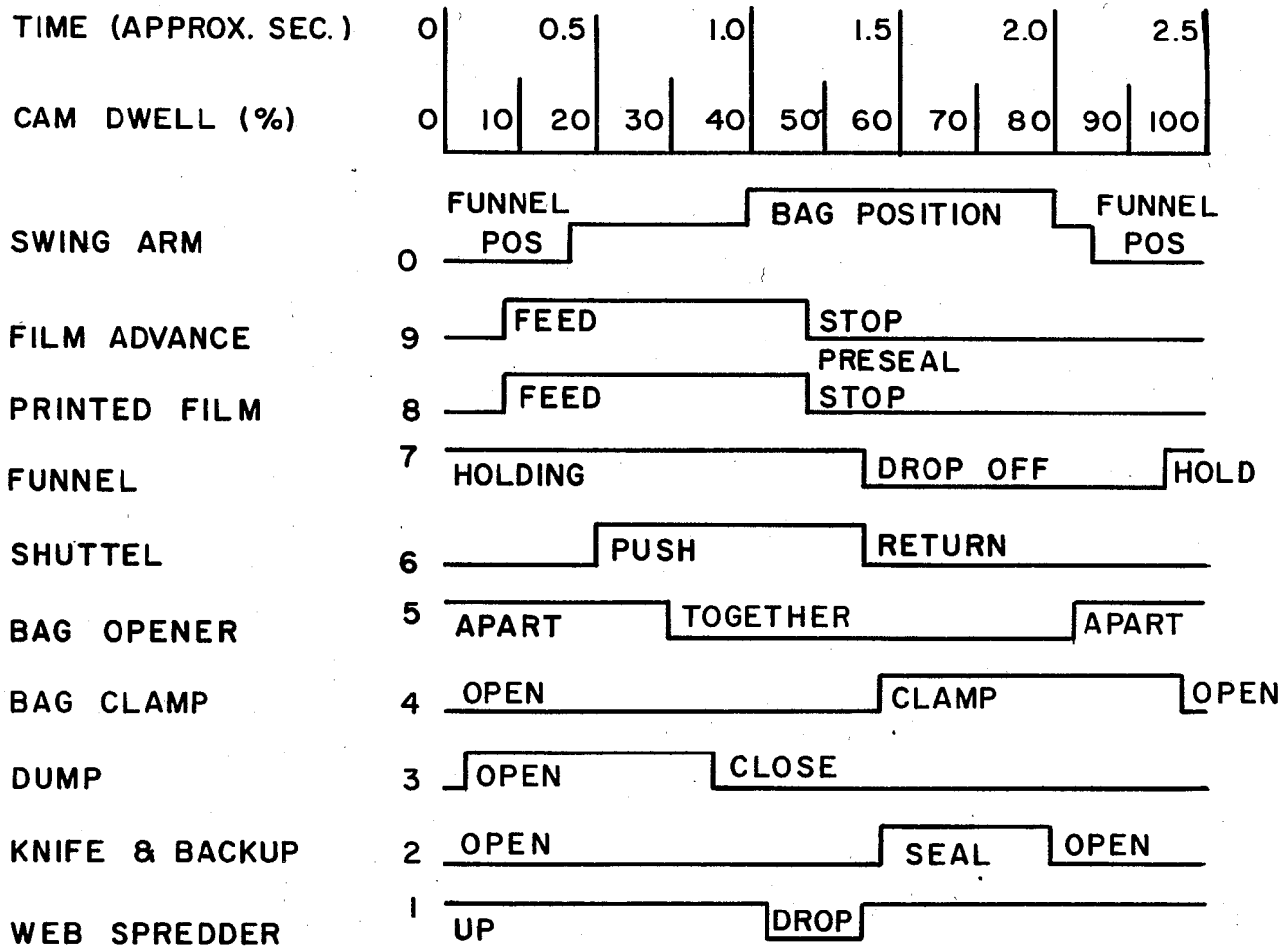
FIG. 12 shows a cycle timing diagram relative to the lapsed time and cam dwell for the various bag forming and filling sequences.

FIG. 11*f* at approximately 85° of dwell, the pedestal 12 is rotated so as to bring the clamped, open mouth of the bag to bear against the snout portions 86 and 88 of the chute 120. At approximately 95° of dwell, the air cylinder 122 is enabled and the upper snout portion 86 is opened so as to clamp the bag to the snout. It remains held there in a slip free manner via the member 125. At 100° of dwell, the clamping plates 70 and 72 are opened so as to release the bag and after which, the filling assembly 14 is enabled to force the produce into the bag.

In particular and noting that for each cycle, while a bag is being prepared, the previously prepared bag is being filled, at approximately 5° of dwell, the air cylinder 114 is enabled so as to cause the hopper plates 112 to open and dump the produce from the hopper 110 into the chute 120. At approximately 20° of dwell, the drive assembly 132 is enabled and the pusher member 128 is advanced so as to push the produce contained within the chute 120 into the contained bag at the snout. The initial and advanced positions of the pusher 128 can be seen from FIG. 11*f*, the advanced position being shown in dotted line. At approximately 55° of dwell, the pusher member or shuttle 128 is returned to its rest position and after which a new quantity of produce is supplied from the hopper 110.

The thus filled bag of produce is then dropped from the chute 120 via the disabling of the air cylinder 122 which relaxes the snout portion 86. However, prior thereto the sealer 54 is positioned so as to receive and support the bag in a central opening thereof while the open end is clamped and sealed with an appropriate tape. The sealer 54 operates asynchronously relative to the bag preparing and filling asemblies and is operative only upon detecting the presence of a filled bag of produce, irrespective of when that occurs. Once a filled bag is dropped, a new bag is then inserted over the snout portions 86 and 88 and clamped at 90° of dwell and a new cycle begins. Thus, for each machine cycle of the present packaging apparatus 2, the film 16 is advanced and a new bag is formed, while a previously formed bag is filled and sealed.

While the present invention has been described with respect to its presently preferred embodiment, it is to be recognized that various modifications may be made thereto without departing from the spirit and scope thereof. Accordingly, it is contemplated that the following claims should include all such embodiments within the scope thereof.

What is claimed is:

1. Packaging apparatus for forming and filling an integrally prepared bag comprising:

frame means of a generally rectangular box-like construction;

a first means for sealing and severing a folded web of film material;

bag forming means secured to said frame including clamping means for releasably holding the opposite folded sides of said film and second means for spreading an open side of said web, said spreading means including a first spring member formed into an inverted "V" shape, said flat spring member being vertically movable relative to a stationary member attached to said frame for controllably spreading the open side of said web as said first folded web is moved past said first means and said flat spring member is raised and lowered relative to said stationary member, said first means sealing and severing a predetermined width of said film from said web to form a bag with an open end;

bag filling means for receiving and supporting the formed bag before filling said bag with a measured amount of product; and control means for synchronously operating said bag forming means relative to said bag filling means.

2. Apparatus as set forth in claim 1 wherein said clamping means includes first and second clamping plates and respective first and second presser feet positioned relative to said first and second clamping plates for clamping said web of film and for controllably retracting and expanding said clamping plates relative to one another.

3. Apparatus as set forth in claim 1, including pedestal means mounted on said frame for reciprocating vertical movement of said flat spring member relative to said stationary member and for rotating a prepared bag from said bag forming means onto said bag filling means.

4. Apparatus as set forth in claim 1 wherein said control means comprises electrical timing means for delivering control signals for responsively synchronously actuating said bag forming means and said bag filling means.

5. Apparatus as set forth in claim 1 wherein said bag filling means comprises a hopper overlying a chute and including means for controllably depositing a predetermined portion of the contents of said hopper into said chute and means in said chute for ejecting the contents from said chute and into said formed bag.

6. Apparatus as set forth in claim 5 wherein said means in said chute comprises a shuttle mounted pusher member reciprocally movable in said chute.

7. Apparatus as set forth in claim 5 wherein said chute includes a snout having a stationary and a movable portion and including means for raising and lowering said movable portion of said snout relative to a formed bag inserted thereover to thereby selectively grasp and release said bag relative to said means for ejecting.

8. Apparatus as set forth in claim 1 wherein said first means comprises an actuatable pivotally mounted anvil for controllably urging said web of film against a hot knife member.

9. Packaging apparatus for forming and filling an integrally prepared bag comprising in combination:

frame means;

means secured to said frame means containing a folded web of film for intermittently advancing a predetermined length thereof corresponding to the width of a desired bag;

film spreading means disposed in the path of travel of said web for spreading the folded sides of said web apart;

clamping means located downstream from said film spreadings means having a pair of clamping plates, each with an associated presser foot, for receiving and clamping the sides defining the open edge of said web therebetween;

means coupled to said frame for raising, lowering and rotating said clamping means relative to said frame;

means for compressively sealing and severing said web of film, thereby forming an open-ended bag; and product feed means for receiving prepared bags from said clamping means for stretching and releasably holding the prepared bag while product is forced into said bag.

10. Apparatus as set forth in claim 9 wherein said product feed means includes a chute having a spreadable jaw for receiving and releasably clamping bags at one end thereof and a hopper for admitting predetermined quantities of product into said chute.

11. Apparatus as set forth in claim 10 for closing said spreadable jaw allowing the filled bag to shrink about the product as said filled bag is released from said product feed means.

* * * * *